US009151503B2

(12) United States Patent
Melton et al.

(10) Patent No.: US 9,151,503 B2
(45) **Date of Patent: *Oct. 6, 2015**

(54) COAXIAL FUEL SUPPLY FOR A MICROMIXER

(71) Applicant: General Electric Company, Schenectady, NY (US)

(72) Inventors: Patrick Benedict Melton, Greenville, SC (US); James Harold Westmoreland, Greenville, SC (US)

(73) Assignee: General Electric Company, Schenectady, NY (US)

( * ) Notice: Subject to any disclaimer, the term of this patent is extended or adjusted under 35 U.S.C. 154(b) by 134 days.

This patent is subject to a terminal disclaimer.

(21) Appl. No.: 13/734,194

(22) Filed: Jan. 4, 2013

(65) Prior Publication Data

US 2014/0190169 A1 Jul. 10, 2014

(51) Int. Cl.

| | |
|---|---|
| ***F23R 3/28*** | (2006.01) |
| ***B01F 5/04*** | (2006.01) |
| ***F23D 14/64*** | (2006.01) |
| *F23R 3/36* | (2006.01) |

(52) U.S. Cl.

CPC ..... *F23R 3/286* (2013.01); *B01F 5/0403* (2013.01); *F23D 14/64* (2013.01); *F23C 2900/03001* (2013.01); *F23R 3/36* (2013.01)

(58) Field of Classification Search

CPC ..... F23R 3/286; F23R 3/34; F23R 3/343; F23R 3/35; F23R 3/32; F23R 3/12; F01F 5/04; B01F 5/04; B01F 5/0403; F23D 14/64; F23C 7/00

USPC ..... 60/737, 738, 740, 746, 774; 239/310, 239/311

See application file for complete search history.

(56) References Cited

U.S. PATENT DOCUMENTS

| | | | | |
|---|---|---|---|---|
| 4,100,733 | A * | 7/1978 | Striebel et al. | 60/39.463 |
| 5,361,586 | A * | 11/1994 | McWhirter et al. | 60/737 |
| 6,397,602 | B2 * | 6/2002 | Vandervort et al. | 60/737 |
| 8,157,189 | B2 * | 4/2012 | Johnson et al. | 239/132.5 |
| 8,181,891 | B2 * | 5/2012 | Ziminsky et al. | 239/430 |
| 8,205,452 | B2 | 6/2012 | Boardman et al. | |
| 8,276,385 | B2 | 10/2012 | Zuo et al. | |
| 8,424,311 | B2 | 4/2013 | York et al. | |
| 8,438,851 | B1 * | 5/2013 | Uhm et al. | 60/737 |
| 8,511,092 | B2 * | 8/2013 | Uhm et al. | 60/772 |
| 8,590,311 | B2 | 11/2013 | Parsania et al. | |
| 8,616,002 | B2 * | 12/2013 | Kraemer et al. | 60/737 |
| 2003/0014975 | A1 * | 1/2003 | Nishida et al. | 60/737 |
| 2003/0101729 | A1 * | 6/2003 | Srinivasan | 60/776 |
| 2004/0060295 | A1 * | 4/2004 | Mandai et al. | 60/725 |
| 2010/0031662 | A1 * | 2/2010 | Zuo | 60/740 |

(Continued)

OTHER PUBLICATIONS

Co-pending U.S. Appl. No. 13/423,894, filed Mar. 19, 2012.

*Primary Examiner* — Phutthiwat Wongwian
*Assistant Examiner* — Rene Ford
(74) *Attorney, Agent, or Firm* — Sutherland Asbill & Brennan LLP

(57) ABSTRACT

Embodiments of the present application can provide systems and methods for a coaxial fuel supply for a micromixer. According to one embodiment, the micromixer may include an elongated base nozzle structure, a number of mixing tubes in communication with the elongated base nozzle structure, and an air inlet configured to supply the plurality of mixing tubes with air. The elongated base nozzle structure may be configured to supply a fuel to the mixing tubes.

7 Claims, 4 Drawing Sheets

(56) References Cited

U.S. PATENT DOCUMENTS

| | | | | |
|---|---|---|---|---|
| 2010/0186413 | A1* | 7/2010 | Lacy et al. | 60/740 |
| 2010/0192579 | A1* | 8/2010 | Boardman et al. | 60/737 |
| 2010/0218501 | A1* | 9/2010 | York et al. | 60/737 |
| 2010/0242493 | A1* | 9/2010 | Cihlar et al. | 60/796 |
| 2010/0275601 | A1 | 11/2010 | Berry et al. | |
| 2010/0287942 | A1* | 11/2010 | Zuo et al. | 60/772 |
| 2011/0016866 | A1* | 1/2011 | Boardman et al. | 60/730 |
| 2011/0057056 | A1 | 3/2011 | Ziminsky et al. | |
| 2011/0083439 | A1* | 4/2011 | Zuo et al. | 60/737 |
| 2011/0113783 | A1* | 5/2011 | Boardman et al. | 60/723 |
| 2011/0265482 | A1* | 11/2011 | Parsania et al. | 60/740 |
| 2012/0055167 | A1* | 3/2012 | Johnson et al. | 60/776 |
| 2012/0079829 | A1* | 4/2012 | Berry et al. | 60/772 |
| 2013/0241089 | A1 | 9/2013 | Westmoreland et al. | |

* cited by examiner

COAXIAL FUEL SUPPLY FOR A MICROMIXER

FIELD OF THE DISCLOSURE

Embodiments of the present application relate generally to gas turbine engines and more particularly to micromixers.

BACKGROUND OF THE DISCLOSURE

Gas turbine efficiency generally increases with the temperature of the combustion gas stream. Higher combustion gas stream temperatures, however, may produce higher levels of undesirable emissions such as nitrogen oxides (NOx) and the like. NOx emissions generally are subject to governmental regulations. Improved gas turbine efficiency therefore must be balanced with compliance with emissions regulations.

Lower NOx emission levels may be achieved by providing for good mixing of the fuel stream and the air stream. For example, the fuel stream and the air stream may be premixed in a Dry Low NOx (DLN) combustor before being admitted to a reaction or a combustion zone. Such premixing tends to reduce combustion temperatures and NOx emissions output.

In current micromixer designs, there are multiple fuel feeds and/or liquid cartridge or blank feeds that obstruct airflow and decrease the mixing of fuel and air. Also, current micromixers are supported by external walls that inhibit air flow to the head end of the micromixer. Accordingly, there is a need for a micromixer that better facilitates fuel and air mixing.

BRIEF DESCRIPTION OF THE DISCLOSURE

Some or all of the above needs and/or problems may be addressed by certain embodiments of the present application. According to one embodiment, there is disclosed a micromixer for a combustor. The micromixer may include an elongated base nozzle structure, a number of mixing tubes in communication with the elongated base nozzle structure, and an air inlet configured to supply the mixing tubes with air. Moreover, the elongated base nozzle structure may be configured to supply a fuel to the plurality of mixing tubes.

According to another embodiment, there is disclosed a segmented micromixer. The segmented micromixer may include an elongated base nozzle structure, a number of mixing tubes forming a segmented tube bundle in communication with and at least partially supported by the base nozzle structure, and an air inlet configured to supply the mixing tubes with air. Moreover, the elongated base nozzle structure may be configured to supply a fuel to the mixing tubes.

Further, according to another embodiment, there is disclosed a segmented micromixer. The segmented micromixer may include one or more elongated base nozzle structure, one or more bundles of mixing tubes each in communication with and at least partially supported by a respective base nozzle structure, and one or more air inlets configured to supply the one or more bundles of mixing tubes with air. Moreover, the one or more elongated base nozzle structures may be configured to supply a fuel to the respective one or more bundles of mixing tubes.

Other embodiments, aspects, and features of the invention will become apparent to those skilled in the art from the following detailed description, the accompanying drawings, and the appended claims.

BRIEF DESCRIPTION OF THE DRAWINGS

Reference will now be made to the accompanying drawings, which are not necessarily drawn to scale, and wherein.

DETAILED DESCRIPTION OF THE DISCLOSURE

Illustrative embodiments will now be described more fully hereinafter with reference to the accompanying drawings, in which some, but not all embodiments are shown. The present application may be embodied in many different forms and should not be construed as limited to the embodiments set forth herein. Like numbers refer to like elements throughout.

Figure 1:
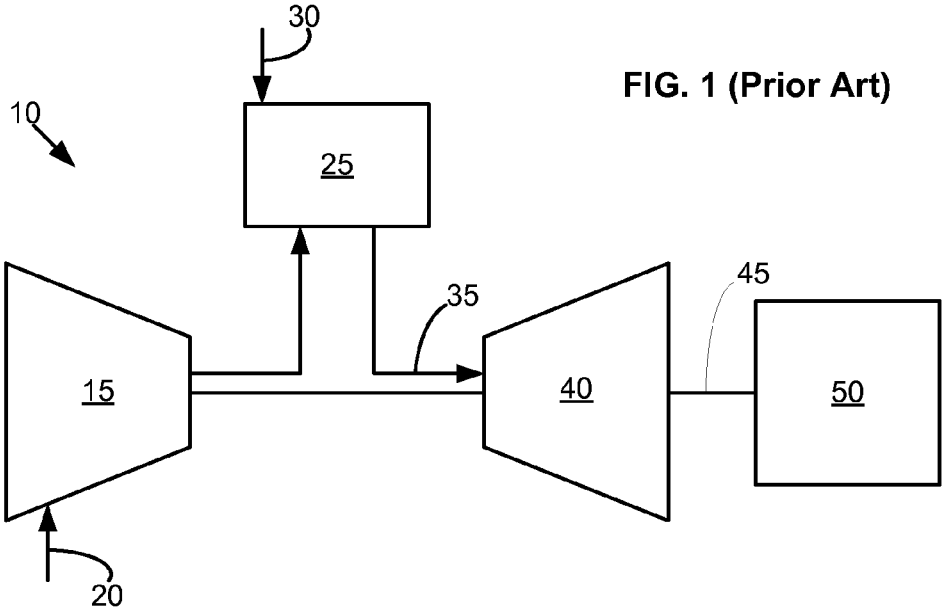
FIG. 1 (Prior Art)
FIG. 1 is a schematic of an example diagram of a gas turbine engine with a compressor, a combustor, and a turbine, according to an embodiment.

Illustrative embodiments are directed to, among other things, micromixers for a combustor. FIG. 1 shows a schematic view of a gas turbine engine 10 as may be used herein. As is known, the gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components.

Other types of gas turbine engines also may be used herein. Multiple gas turbine engines, other types of turbines, and other types of power generation equipment also may be used herein together.

Figure 2:
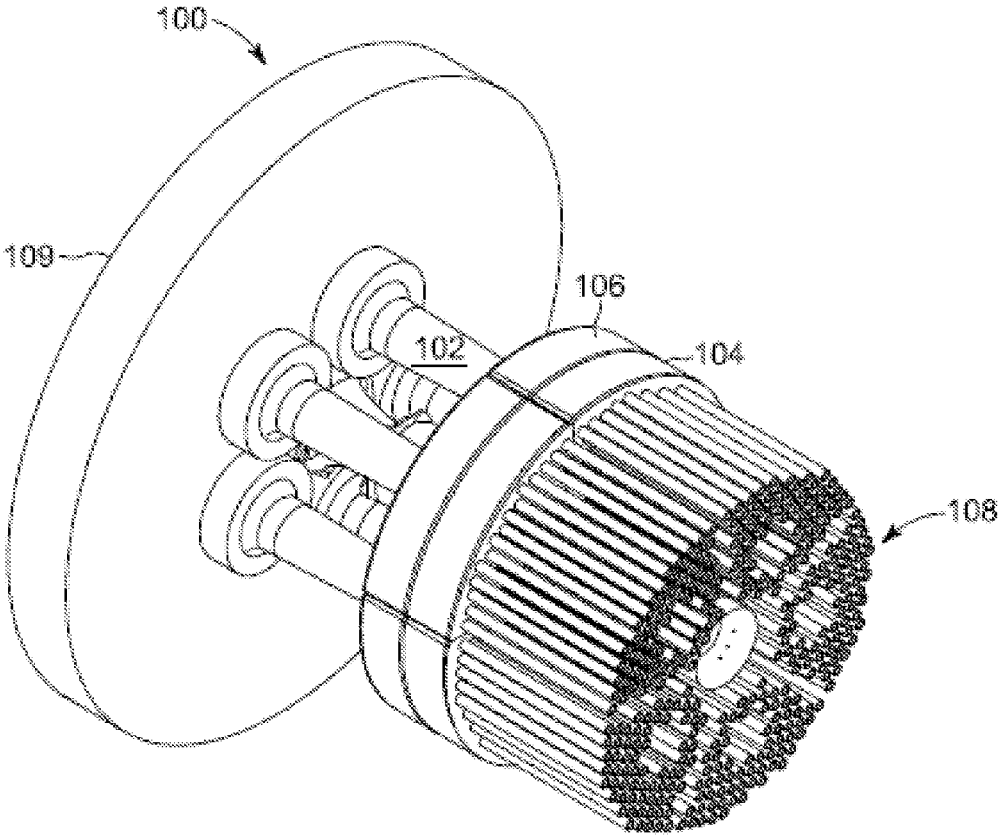
FIG. 2 is a perspective view of a micromixer, according to an embodiment.
Figure 3:
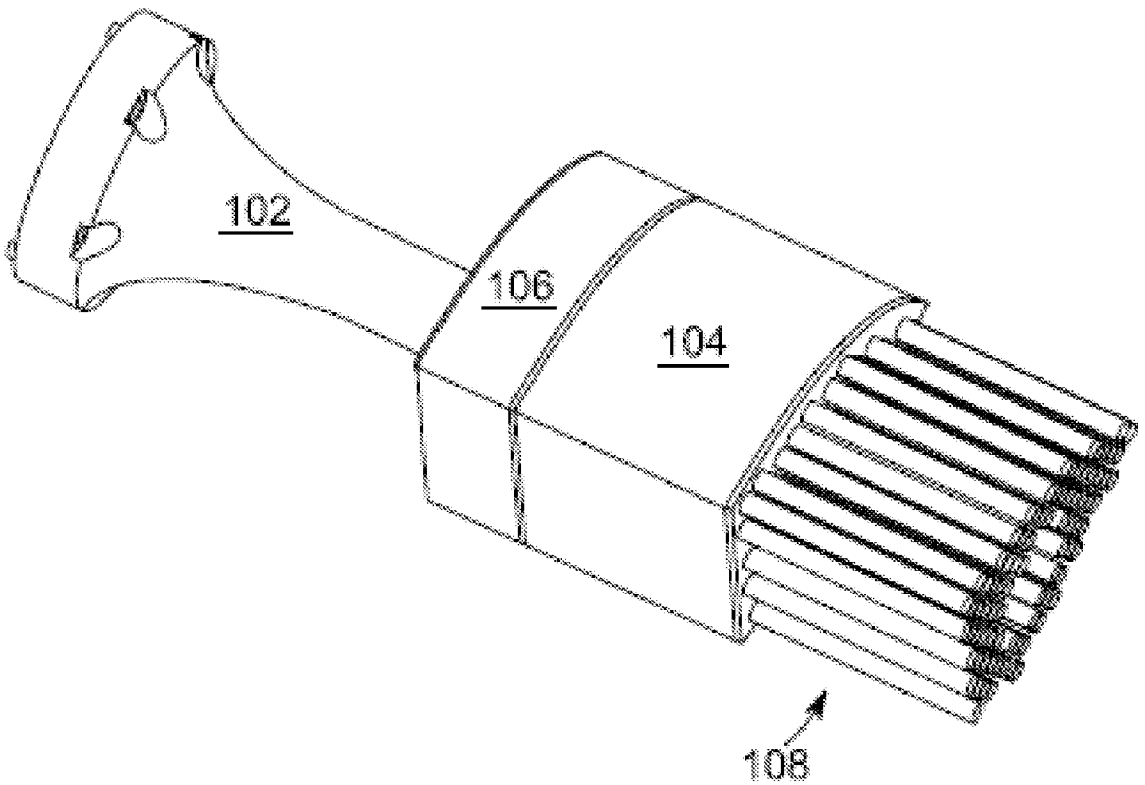
FIG. 3 is a perspective view of a portion of a micromixer, according to an embodiment.

FIGS. 2 and 3 depict a component of the combustor 25 in FIG. 1; specifically, a micromixer 100 or a portion thereof. Generally speaking, the micromixer 100 can include an elongated base nozzle structure 102 in communication with a fuel plenum 104, an air intake 106, and numerous mixing tubes 108. In certain embodiments, the elongated base nozzle structure 102 may supply a fuel to the fuel plenum 104. The fuel may exit the fuel plenum 104 and enter the mixing tubes 108. Moreover, air may be directed into the mixing tubes 108 through the air intake 106 and mix with the fuel to create an air/fuel mixture. The air/fuel mixture may exit the mixing tubes 108 and enter into a downstream combustion chamber.

Still referring to FIGS. 2 and 3, in one embodiment, the micromixer 100 may be segmented, meaning the micromixer 100 may include a number of elongated base nozzle structures 102. For example, in the segmented micromixer 100, each base nozzle structure 102 may be associated with a bundle of mixing tubes 108 that are at least partially supported by the respective elongated base nozzle structure 102. The elongated base nozzle structures 102 may be attached to a combustor endplate 109.

Figure 4:
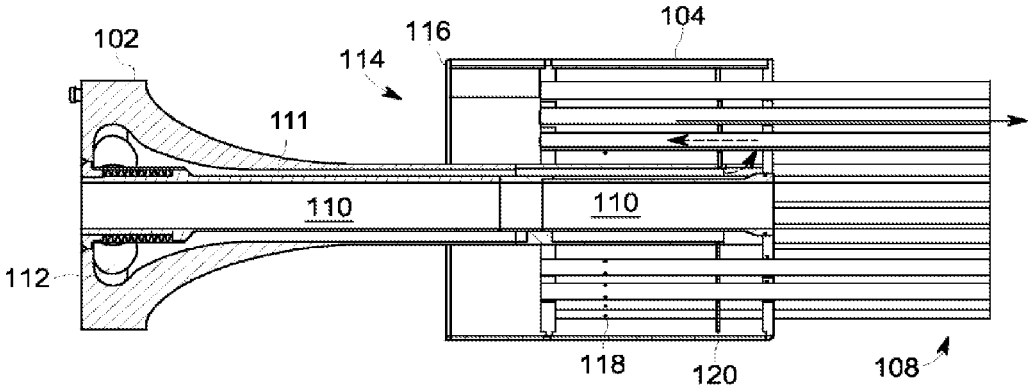
FIG. 4 is a cross-section of an example diagram of a portion of a micromixer, according to an embodiment.

In an embodiment, as depicted in FIG. 4, the micromixer 100 may include an elongated base nozzle structure 102 having coaxial tubes including an inner tube 110 and an outer tube 112. In some instances, an annulus 111 formed between the inner tube 110 and the outer tube 112 may supply a fuel to the mixing tubes 108. In such instances, the inner tube 110 of the coaxial tubes may supply a liquid cartridge or blank directly to the combustion chamber. Similarly, the inner tube 110 of the coaxial tube may include an igniter or flame detector. One will appreciate, however, that the inner tube 110 of the coaxial tubes may include a variety of combustor components. In other instances, however, the elongate base nozzle structure 102 may include only a single tube. For example, the inner tube 110 may not be included, leaving only the outer tube 112. In such instances, the outer tube 112 may be configured to supply the fuel to the mixing tubes 108.

In an embodiment, an air inlet 114 may be disposed upstream of the mixing tubes 108 to supply air to the mixing tubes 108. In other embodiments, an air conditioner plate 116 may be disposed upstream of the mixing tubes 108.

In one embodiment, the fuel supplied by the annulus 111 formed between the coaxial tubes 110 and 112 may enter the fuel plenum 104 before entering the mixing tubes 108. In some instances, the fuel entering the fuel plenum 104 may be redirected 180 degrees (as indicated by the dashed arrows at the end of outer tube 112) before entering the mixing tubes 108 through one or more holes 118 in the mixing tubes 108. In other instances, the fuel may enter the fuel plenum 104 directly without being redirected.

In one embodiment, a fuel conditioning plate 120 may be disposed within the fuel plenum 104. In another embodiment, the fuel plenum 104 may not include the fuel conditioning plate 120. The air/fuel mixture exits the mixing tubes 108 (as indicated by the solid arrow within the mixing tubes 108) into the combustion chamber.

In certain embodiments, the micromixer may include a dampening mechanism disposed about the micromixer assembly. For example, a hula spring may be disposed between the micromixer assembly and an outer support structure of the combustor. The hula spring may dampen the vibration associated with the combustor and provide additional support to the micromixer assembly.

The elongated base nozzle structure 102 of the micromixer 100 provides both structural support and facilitates the fuel to entering the fuel plenum 104. As stated above, the fuel can be any type of gas. The inner tube 110 may include a liquid cartridge (for dual fuel), a blank cartridge (for gas only), an igniter, a flame detector, or any other combustor component. The base nozzle structure 102 is attached to the inlet plate 116 of the micromixer assembly. The fuel is injected from the end cover 109 into the base nozzle structure 102 and flows through the annulus 11 formed between inner tube 110 and the outer tube 112 into the fuel plenum 104. The fuel then enters the mixing tubes via the holes 118 where it is mixed with head end air. The head end air flows through the flow conditioning plate 116 and into the mixing tube 108 where the fuel and air are mixed together before exiting the mixing tubes 108 into the combustion chamber.

For each segmented portion of the micromixer, there is only one air side flow obstruction—the nozzle base structure. Accordingly, the present micromixer reduces the number of protrusions into the air flow path so as to facilitate a more uniform air feed in the mixing tubes. Moreover, the fuel flow reversal allows for more uniform fuel heating resulting in improved NOx performance.

A technical advantage of the present micromixer includes a more uniform air feed to the mixing tubes. Another advantage of the present micromixer is that it facilitates fuel feed distribution to the mixing tubes and does not require a complex base nozzle structure to support the micromixer assembly. This results in a micromixer assembly that has lower NOx emissions because the air and fuel distribution are more uniform. The overall cost of the micromixer may be less and it may be more reliable because the number of welds is reduced, the number of parts is decreased, and the analytical assessment is more straightforward.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments.

That which is claimed:

1. A micromixer for a combustor having a combustion chamber, the micromixer comprising:

an end plate;

an elongated base nozzle structure extending from the end plate, wherein the elongated base nozzle structure comprises coaxial tubes comprising an inner tube and an outer tube;

a plurality of mixing tubes at least partially supported by the elongated base nozzle structure, wherein the plurality of mixing tubes comprise a first end and a second end, and wherein the first end of the plurality of mixing tubes is spaced apart from the end plate to form an air inlet about the elongated base nozzle structure; and a fuel plenum disposed around the plurality of mixing tubes downstream of the air inlet and between the first end and the second end of the plurality of mixing tubes, wherein an annulus is formed between the inner tube and the outer tube of the coaxial tubes and is in fluid communication with the fuel plenum, and wherein the inner tube of the coaxial tubes is in direct fluid communication with the combustion chamber, wherein the fuel plenum is formed around one or more holes in the plurality of mixing tubes which are disposed between the first end and the second end of the plurality of mixing tubes, the fuel plenum being in communication with the elongated base nozzle structure such that a fuel supplied by the annulus formed between the inner tube and outer tube of the coaxial tubes enters the fuel plenum before entering the plurality of mixing tubes through the one or more hole in the plurality of mixing tubes.

2. The micromixer of claim 1, wherein the annulus formed between the inner tube and the outer tube of the coaxial tubes is configured to supply a first fuel to the plurality of mixing tubes.

3. The micromixer of claim 1, wherein the inner tube of the coaxial tubes is configured to supply a second fuel directly to the combustion chamber.

4. The micromixer of claim 1, wherein the annulus formed between the inner tube and the outer tube the coaxial tubes comprises an outlet into the fuel plenum, wherein the outlet is downstream of the one or more holes in the plurality of mixing tube relative to a flow direction in the plurality of mixing tubes such that the fuel entering the fuel plenum is redirected 180 degrees before entering the plurality of mixing tubes through the one or more holes in the plurality of mixing tubes.

5. The micromixer of claim 1, further comprising a fuel conditioning plate disposed within the fuel plenum.

6. The micromixer of claim 1, further comprising an air conditioner plate disposed upstream of the plurality of mixing tubes.

7. The micromixer of claim 1, further comprising a plurality of elongated base nozzle structures and associated bundles of mixing tubes arranged to form a segmented micromixer.

* * * * *